US009270087B2

(12) United States Patent
Nagasawa et al.

(10) Patent No.: US 9,270,087 B2
(45) **Date of Patent: *Feb. 23, 2016**

(54) SPARK PLUG WITH IMPROVED GROUND ELECTRODE JOINED TO METAL SHELL

(71) Applicant: NGK Spark Plug Co., Ltd., Nagoya-shi, Aichi (JP)

(72) Inventors: Satoshi Nagasawa, Aichi (JP); Akira Suzuki, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/469,005

(22) Filed: Aug. 26, 2014

(65) Prior Publication Data

US 2014/0368105 A1 Dec. 18, 2014

Related U.S. Application Data

(63) Continuation of application No. 13/881,410, filed as application No. PCT/JP2011/004619 on Aug. 18, 2011, now Pat. No. 8,884,503.

(30) Foreign Application Priority Data

Nov. 4, 2010 (JP) ..... 2010-247603

(51) Int. Cl.
*H01T 13/32* (2006.01)
*H01T 13/16* (2006.01)

(52) U.S. Cl.
CPC ..... *H01T 13/16* (2013.01); *H01T 13/32* (2013.01)

(58) Field of Classification Search
CPC ..... H01T 13/16; H01T 13/32; H01T 13/39
USPC ..... 313/141, 142, 144
See application file for complete search history.

(56) References Cited

U.S. PATENT DOCUMENTS 5,530,313 A 6/1996 Chiu ..... 313/141

FOREIGN PATENT DOCUMENTS

| | | | |
|---|---|---|---|
| JP | S51-112131 | 9/1976 | |
| JP | S55-15665 Y2 | 4/1980 | ..... H01T 13/20 |
| JP | 11-185928 | 7/1999 | ..... H01T 13/20 |
| JP | 2001-284013 A | 10/2001 | ..... H01T 13/20 |
| JP | 2005-228562 A | 8/2005 | ..... F02T 13/00 |
| JP | 2010-086951 A | 4/2010 | ..... H01T 13/32 |

OTHER PUBLICATIONS

International Search Report from corresponding International Patent Application No. PCT/JP2011/004619 (English-language translation provided).
Office Action issued in corresponding Chinese Patent Application No. 201180052294.7, Mar. 13, 2014 (Concise Explanation of Relevance of Non-English Language Document provided).
Office Action issued in corresponding Korean Patent Application No. 20130106412, May 14, 2014 (Concise Explanation of Relevance of Non-English Language Document provided).
Office Action issued in corresponding Chinese Patent Application No. 201410353091.7, dated Nov. 25, 2015.

*Primary Examiner* — Anh Mai
*Assistant Examiner* — Steven Horikoshi
(74) *Attorney, Agent, or Firm* — Kusner & Jaffe

(57) ABSTRACT

A spark plug has a metal shell and a ground electrode joined at a base end portion thereof to the metal shell and includes a surface layer and a core higher in thermal conductivity than the surface layer. The core includes a first core member and a second core member. A weld region, where the ground electrode is joined to the metal shell, has an undulating shape. A distance between frontmost and rearmost ends of a part of the weld region in contact with the first core member in the axis direction is 0.15 mm or more.

7 Claims, 19 Drawing Sheets

| | |
|---|---|
| 10 | Ceramic insulator |
| 12 | Axial hole |
| 20 | Center electrode |
| 30 | Ground electrode |
| 37 | Base end portion |
| 38 | Distal end portion |
| 50 | Metal shell |
| 100 | Spark plug |
| OL | Axis |

| | |
|---|---|
| 10 | Ceramic insulator |
| 20 | Center electrode |
| 30 | Ground electrode |
| 50 | Metal shell |
| 58 | Weld region |
| OL | Axis |
| CA1 | Center line |
| PD | Specific direction |

FIG. 4

(A)

Ground Electrode: W (W2) 1.1 × L 2.2, Metal Shell: Outer Diameter OD ϕ 8.5
(unit: mm)

| Inner Diameter ID | | 5.8 | 6.0 | 6.2 | 6.4 |
|---|---|---|---|---|---|
| Metal Shell Width W1 = (OD−ID)/2 | | 1.325 | 1.225 | 1.125 | 1.025 |
| Surface Layer Thickness W3 | 0.4 | ○ | ○ | ○ | △ |
| | 0.2 | ○ | ○ | △ | △ |

(B)

Ground Electrode: W (W2) 1.3 × L 2.7, Metal Shell: Outer Diameter OD ϕ 10.1
(unit: mm)

| Inner Diameter ID | | 6.8 | 7.0 | 7.2 | 7.4 |
|---|---|---|---|---|---|
| Metal Shell Width W1 = (OD−ID)/2 | | 1.65 | 1.55 | 1.45 | 1.35 |
| Surface Layer Thickness W3 | 0.4 | ○ | ○ | ○ | △ |
| | 0.2 | ○ | ○ | △ | △ |

(C)

Ground Electrode: W (W2) 1.5 × L 2.8, Metal Shell: Outer Diameter OD ϕ 12.1
(unit: mm)

| Inner Diameter ID | | 8.2 | 8.4 | 8.6 | 8.8 |
|---|---|---|---|---|---|
| Metal Shell Width W1 = (OD−ID)/2 | | 1.95 | 1.85 | 1.75 | 1.65 |
| Surface Layer Thickness W3 | 0.4 | ○ | ○ | ○ | △ |
| | 0.2 | ○ | ○ | ○ | △ |

FIG. 5
(A)
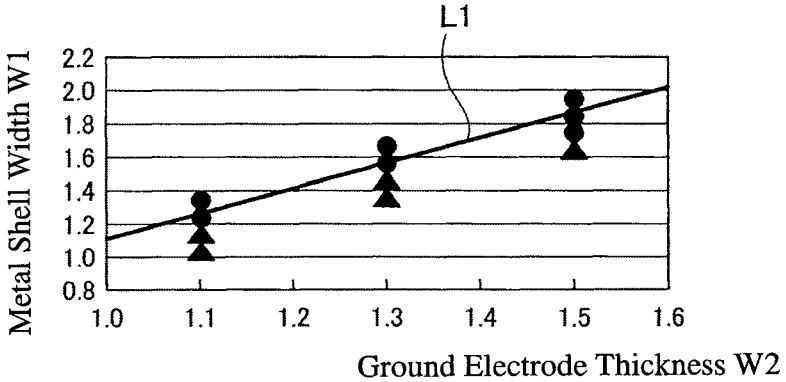
Surface Layer Thickness W3 = 0.20 mm
(B)
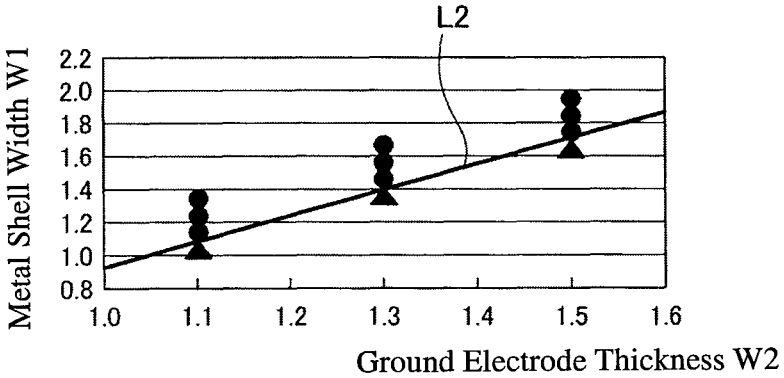
Surface Layer Thickness W3 = 0.40 mm

FIG. 7

| Ground Electrode Dimensions (mm) | Weld End Distance D1 (mm) | Average Rupture Time RT (min) |
|---|---|---|
| W 1.1 × L 2.2 | 0.05 | 31 |
| | 0.14 | 60 |
| | 0.18 | 60 |
| W 1.3× L 2.7 | 0.07 | 27 |
| | 0.13 | 46 |
| | 0.22 | 58 |
| W 1.5× L 2.8 | 0.10 | 16 |
| | 0.15 | 46 |
| | 0.25 | 60 |

| | |
|---|---|
| 330 | Ground electrode |
| 331 | Surface layer |
| 332 | Core |
| 333 | First core member |
| 334 | Second core member |
| 350 | Metal shell |
| OL | Axis |
| SG | Spark gap |
| MP | Midpoint |
| IP | Intersection point |
| VL1 | First imaginary line |
| VL2 | Second imaginary line |
| PD | Specific direction |

| | |
|---|---|
| 330 | Ground electrode |
| 350 | Metal shell |
| 338 | Distal end portion |

FIG. 11

| Total Thickness of Surface Layer W5 (= W51 + W52) (mm) | Total Thickness of Second Core Member (Copper) W4 (= W41 + W42) (mm) | W4/W5 | Displacement Amount DD (mm) |
|---|---|---|---|
| 1.58 | 0.36 | 0.23 | 0.00 |
| 1.55 | 0.36 | 0.23 | 0.00 |
| 1.52 | 0.48 | 0.32 | 0.00 |
| 1.57 | 0.53 | 0.34 | 0.00 |
| 1.55 | 0.66 | 0.43 | 0.05 |
| 1.57 | 0.66 | 0.42 | 0.08 |
| 1.34 | 0.20 | 0.15 | 0.00 |
| 1.34 | 0.19 | 0.14 | 0.00 |
| 1.36 | 0.31 | 0.23 | 0.00 |
| 1.34 | 0.32 | 0.24 | 0.00 |
| 1.35 | 0.41 | 0.30 | 0.00 |
| 1.37 | 0.43 | 0.31 | 0.00 |
| 1.35 | 0.52 | 0.39 | 0.11 |
| 1.36 | 0.52 | 0.38 | 0.06 |

| | |
|---|---|
| 420 | Center electrode |
| 430 | Ground electrode |
| 431 | Surface layer |
| 432 | Core |
| 450 | Metal shell |
| 458 | Weld region |
| PP | Specific position |
| PD | Specific direction |
| CA2 | Center line |
| CA3 | Center line |

FIG. 14

| Ground Electrode Dimensions (mm) | Offset Amount OF (mm) | Average Rupture Time RT (min) |
|---|---|---|
| W 1.1 × L 2.2 | 0.00 | 31 |
| | 0.07 | 60 |
| | 0.14 | 60 |
| W 1.3× L 2.7 | 0.00 | 27 |
| | 0.10 | 60 |
| | 0.18 | 60 |
| W 1.5× L 2.8 | 0.00 | 16 |
| | 0.09 | 44 |
| | 0.21 | 60 |

| | |
|---|---|
| 530 | Ground electrode |
| 531 | Surface layer |
| 532 | Core |
| 538 | Distal end portion |
| 539 | End point |
| 550 | Metal shell |
| OL | Axis |
| PD | Specific direction |

FIG. 17

| Ground Electrode Dimensions (mm) | W6/W7 (−) | Average Rupture Time RT (min) |
|---|---|---|
| W 1.1 × L 2.2 | 1.00 | 31 |
| | 1.04 | 46 |
| | 1.11 | 55 |
| | 1.11 | 60 |
| W 1.3× L 2.7 | 1.00 | 27 |
| | 1.05 | 42 |
| | 1.11 | 44 |
| | 1.22 | 60 |
| W 1.5× L 2.8 | 1.00 | 16 |
| | 1.04 | 30 |
| | 1.10 | 33 |
| | 1.19 | 41 |

W6: Ground Electrode Thickness (mm) at Bottom Part (End Points) of Core

W7: Ground Electrode Thickness (mm) at Distal End Portion

SPARK PLUG WITH IMPROVED GROUND ELECTRODE JOINED TO METAL SHELL

RELATED APPLICATIONS

This is a continuation of U.S. patent application Ser. No. 13/881,410, filed Apr. 25, 2013, which claims priority from PCT Application Number PCT/JP11/04619, filed on Aug. 18, 2011 and claims priority from Japanese Patent Application No. JP 2010-247603, filed on Nov. 4, 2010, the content of which is incorporated herein by reference.

FIELD OF THE INVENTION

The present invention relates to a spark plug for an internal combustion engine and, more particularly, to a ground electrode of the spark plug.

BACKGROUND OF THE INVENTION

It is required that a ground electrode (outer electrode) of a spark plug used in an internal combustion engine has heat resistance due to the fact that the ground electrode is subjected to high-temperature conditions. There is thus known a spark plug of the type in which a ground has a multilayer structure of a plurality of layers including a surface layer and a core formed of a higher thermal conductivity material such as copper or copper alloy inside the surface layer in order to promote heat radiation for improvement in heat resistance (see, for example, Japanese Laid-Open Patent Publication No. H11-185928). In this type of spark plug, the ground electrode is generally joined to a metal shell by resistance welding.

The heat resistance of the multilayer ground electrode increases with the amount of the core. On the other hand, the thickness of the surface layer decreases with increase in the amount of the core. The highly heat-conductive core does not largely contribute to the resistance welding strength between the ground electrode and the metal shell. Otherwise, the joint strength between the ground electrode and the metal shell decreases according to an increase in the amount of the core because the core is lower in strength than the surface layer.

Further, the surface layer spreads outwardly (as a welding burr) during the resistance welding of the ground electrode and the metal shell due to differences in melting point and strength between the surface layer and the core. A redundant part of such a spread of the surface layer is generally removed. However, the joint strength between the ground electrode and the metal shell further decrease upon removal of the part of the surface layer. The durability of the spark plug may deteriorate as the joint strength between the ground electrode and the metal shell decreases as mentioned above.

SUMMARY OF THE INVENTION

In view of at least part of the above problems, it is an object of the present invention to provide a spark plug in which a multilayer ground electrode is joined by resistance welding to a metal shell so as to secure favorable joint strength between the ground electrode and the metal shell.

The present invention has been made to solve at least part of the above problems and can be embodied in the following aspects or application examples.

Application Example 1

A spark plug, comprising:

a rod-shaped center electrode extending in an axis direction of the spark plug;

an insulator having an axial hole formed in the axis direction so as to retain the center electrode in the axial hole;

a metal shell circumferentially surrounding and retaining the insulator; and a ground electrode having a base end portion welded to the metal shell and a distal end portion facing an axially front end portion of the center electrode with a gap left between the distal end portion of the ground electrode and the front end portion of the center electrode, the ground electrode including a surface layer defining a surface of the ground electrode and a core located inside the surface layer and having a higher thermal conductivity than that of the surface layer, the surface layer having a thickness of 0.2 mm to 0.4 mm at a specific position that is located 1 mm from the base end portion in a direction toward the distal end portion along an outer shape of the ground electrode, wherein the spark plug satisfies the following condition: $W1 \geq W2 \times 1.55 - (W3 + 0.25)$ where W1 (mm) is a width of the metal shell at a weld region of the metal shell joined with the base end portion in a specific direction that extends perpendicular to the axis direction through a center line of the ground electrode; W2 (mm) is a thickness of the ground electrode at the specific position in the specific direction; and W3 (mm) is a thickness of the surface layer at the specific position in the specific direction.

Application Example 2

The spark plug according to Application Example 1, wherein the core includes a first core member located on an inner side thereof and a second core member located on an outer side thereof so as to circumferentially surround the first core member and having a higher thermal conductivity and a lower hardness than those of the first core member;

wherein the first core member has a protruding shape that protrudes to a rear of the second core member in the axis direction;

wherein the weld region has an undulating shape that undulates according to the protruding shape of the first core member; and wherein a distance between frontmost and rearmost ends of a part of the weld region in contact with the first core member in the axis direction is 0.15 mm or more.

Application Example 3

The spark plug according to Application Example 1, wherein the core includes a first core member located on an inner side thereof and a second core member located on an outer side thereof so as to circumferentially surround the first core member and having a higher thermal conductivity and a lower hardness than those of the first core member; and wherein, when viewed in cross section along a plane defined by the axis direction and the specific direction, the spark plug satisfies the following condition: $W4/W5 \leq 0.34$ where, on the assumption that: a first imaginary line extends in parallel to the specific direction through a midpoint of a spark gap SG, which is defined between the center electrode and the ground electrode in the axis direction; and a second imaginary line passes through an intersection point of the first imaginary line and a plane of the ground electrode located closer to the center electrode and intersecting the first imaginary line at an elevation angle of 45 degrees toward the specific direction, W4 is the sum of widths of the second core member on the secondary imaginary line; and W5 is the sum of widths of the surface layer on the second imaginary line.

Application Example 4

The spark plug according to Application Example 2, wherein, when viewed in cross section along a plane defined by the axis direction and the specific direction, the spark plug satisfies the following condition: $W4/W5 \leq 0.34$ where, on the assumption that: a first imaginary line extends in parallel to the specific direction through a midpoint of a spark gap SG, which is defined between the center electrode and the ground electrode in the axis direction; and a second imaginary line passes through an intersection point of the first imaginary line and a plane of the ground electrode located closer to the center electrode and intersecting the first imaginary line at an elevation angle of 45 degrees toward the specific direction, W4 is the sum of widths of the second core member on the secondary imaginary line; and W5 is the sum of widths of the surface layer on the second imaginary line.

Application Example 5

The spark plug according to any one of Application Examples 1 to 4, wherein, when viewed in cross section parallel to a plane defined by the axis direction and the specific direction, a center line of the ground electrode extending at the specific position in the axis direction is located closer to the center electrode than a center line of the metal shell extending at the weld region in the axis direction.

Application Example 6

The spark plug according to any one of Application Examples 1 to 5, wherein, when viewed in cross section parallel to a plane defined by the axis direction and the specific direction, the metal shell has a protruding shape that protrudes at the center thereof toward the front in the axial direction, and the core has an undulating shape that undulates according to the protruding shape of the metal shell, and an outer thickness of the ground electrode in the specific direction at axially rear end points of the core is larger than a thickness of the distal end portion of the ground electrode.

In the spark plug of Application Example 1, the ground electrode includes the surface layer and the core having a higher thermal conductivity than that of the surface layer. It is therefore possible to improve the heat resistance of the ground electrode. It is also possible to secure favorable joint strength between the ground electrode and the metal shell by keeping the surface layer and the core in balance with each other.

In the spark plug of Application Example 2, the core includes the first core member located in the inner side thereof and the second core member located in the outer side thereof. Further, the first core member is higher in hardness than the second core member. It is therefore possible to improve the joint strength between the ground electrode and the metal shell. The joint strength can be further improved by forming the welding face between the ground electrode and the metal shell into a predetermined undulating shape.

In the spark plug of Application Example 3, the surface layer and the core can be kept in balance so that it is possible to prevent the ground electrode from becoming deformed by heating/cooling cycles during actual use of the spark plug on the internal combustion engine.

In the spark plug of Application Example 4, the surface layer and the core can be kept in balance so that it is possible to prevent the ground electrode from becoming deformed by heating/cooling cycles during actual use of the spark plug on the internal combustion engine.

In the spark plug of Application Example 5, the joint strength between the ground electrode and the metal shell can be improved.

In the spark plug of Application Example 6, the joint strength between the ground electrode and the metal shell can be improved by securing the thickness of the ground electrode at the base end part of the core.

BRIEF DESCRIPTION OF THE DRAWINGS

FIGS. 4(A) to 4(C) are tables showing test results about the welding strength between the ground electrode 30 and metal shell 50.

FIGS. 5(A) and 5(B) are a graph showing test results about the welding strength between the ground electrode 30 and metal shell 50.

FIG. 7 is a table showing impact test results on the spark plug 200.

FIG. 11 is a table showing test results about the deformation of the ground electrode 330 due to heating/cooling cycles.

FIG. 14 is a table showing impact test results on the spark plug 400.

FIG. 17 is a table showing impact test results on the spark plug 500.

DETAILED DESCRIPTION OF PREFERRED EMBODIMENTS

A. First Embodiment

Figure 1:
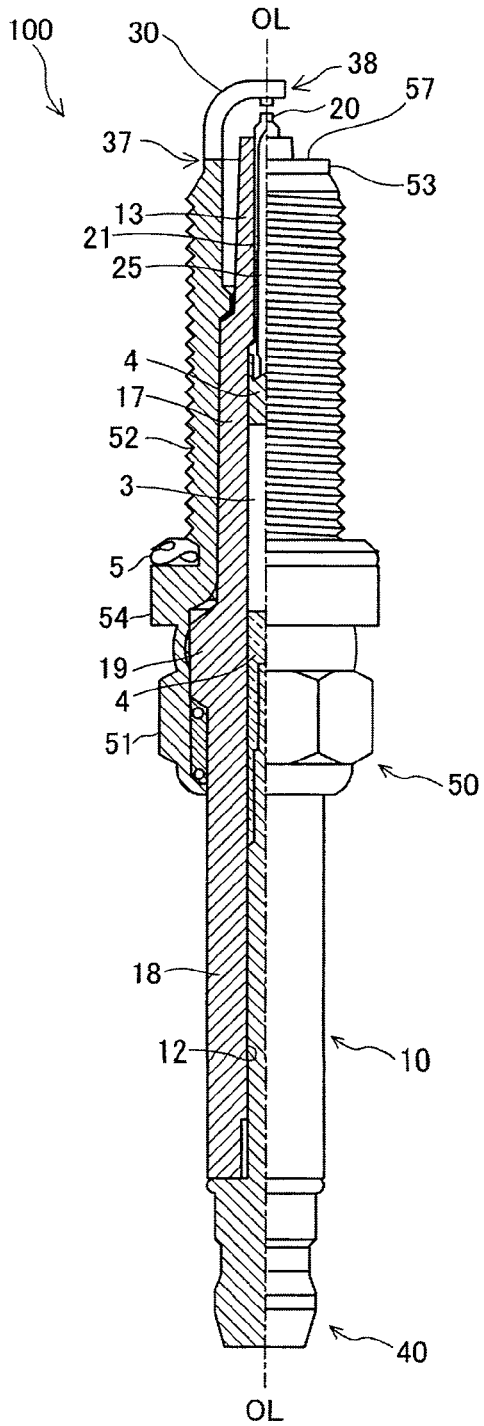
FIG. 1 is a schematic view, partly in cross section, of a spark plug 100.

A first embodiment of the present invention will be described below. FIG. 1 is a schematic view, partly in cross section, of a spark plug 100 according to the first embodiment of the present invention. In the following explanation, upper and lower sides in FIG. 1 are referred to as front and rear sides with respect to the direction of an axis OL of the spark plug 100, respectively. The spark plug 100 includes a ceramic insulator 10, a center electrode 20, a ground electrode 30, a terminal rod 40 and a metal shell 50.

The center electrode 20 is a rod-shaped electrode protruding from a front end of the ceramic insulator 10. The terminal rod 40 is inserted in a rear side of the ceramic insulator 10; and the center electrode 20 is electrically connected to the terminal rod 40 within the ceramic insulator 10. An outer circumference of the center electrode 20 is retained by the ceramic insulator 10, whereas an outer circumference of the ceramic insulator 10 is retained by the metal shell 50 at a position apart from the terminal rod 40.

The ceramic insulator 10 is a cylindrical insulator having, in the center thereof, an axial hole 12 in which the center electrode 20 and the terminal rode 40 are inserted. The ceramic insulator 10 is formed by sintering a ceramic material such as alumina. The ceramic insulator 10 includes a middle body portion 19 located at an axially middle position thereof and having an enlarged outer diameter, a rear body portion 18 located rear of the middle body portion 19 so as to provide an insulation between the terminal rod 40 and the metal shell 50, a front body portion 17 located front of the middle body portion 19 and having an outer diameter made smaller than that of the rear body portion 18 and a leg portion 13 located front of the front body portion 17 and having an outer diameter made smaller than that of the front body portion 17 in such a manner that the outer diameter of the leg portion 13 gradually decreases toward the center electrode 20.

The metal shell 50 is a cylindrical metal fixture surrounding and retaining therein a part of the ceramic insulator 10 extending from some point of the rear body portion 18 to the leg portion 13. In the present embodiment, the metal shell 50 is formed of low carbon steel. The metal shell 50 includes a tool engagement portion 51, a mounting thread portion 52, a cylindrical portion 53 and a seal portion 54. The tool engagement portion 51 of the metal shell 50 is engageable with a tool for mounting the spark plug 100 onto an engine head. The mounting thread portion 52 of the metal shell 50 has a screw thread screwed into a mounting thread hole of the engine head. The seal portion 54 of the metal shell 50 is formed into a flange shape at a bottom of the mounting thread portion 52. An annular gasket 5, which is formed by bending a plate material, is disposed between the seal portion 54 and the engine head (not shown). A front end face 57 of the metal shell 50 is formed into a hollow circle shape so that the center electrode 20 protrudes from the leg portion 13 of the ceramic insulator 10 through the center of the front end face 57 of the metal shell 50.

The center electrode 20 has a rod shape including a bottomed cylindrical electrode body 21 and a core 25 having a higher thermal conductivity than that of the electrode body 21 and embedded in the electrode body 21. In the present embodiment, the electrode body 21 is formed of a nickel alloy containing nickel as a main component; and the core 25 is formed of copper or an alloy containing copper as a main component. The center electrode 20 is inserted in the axial hole 12 of the ceramic insulator 10, with a front end of the electrode body 21 protruding from the axial hole 12 of the ceramic insulator 10, and is electrically connected to the terminal rod 40 via a ceramic resistor 3 and a seal member 4.

The ground electrode 30 is joined at one end portion, i.e., a base end portion 37 thereof to the front end face 57 of the metal shell 50 and is bent in such a manner that the other end portion, i.e., a distal end portion 38 of the ground electrode 30 faces a front end portion of the center electrode 20. In the present embodiment, the ground electrode 30 has a two-layer structure. The inner structure of the ground electrode 30 will be explained in detail later. The base end portion 37 of the ground electrode 30 and the front end face 57 of the metal shell 50 are joined together by resistance welding. There is a spark gap defined between the distal end portion 38 of the ground electrode 30 and the front end portion of the center electrode 20.

Figure 2:
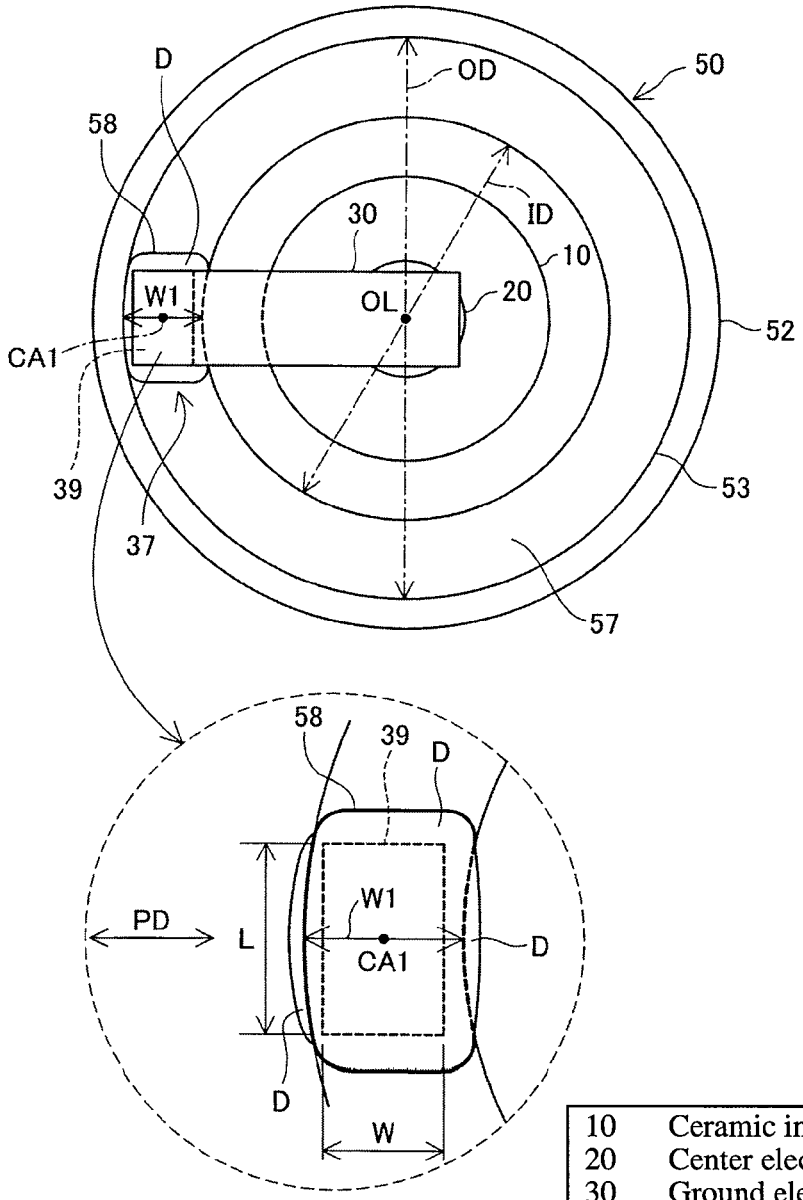
FIG. 2 is an outer appearance view of a front end portion of the spark plug 100 when viewed from the front end side.

FIG. 2 is an outer appearance view of the spark plug 100 when viewed from the front end side. As shown in the drawing, the cylindrical portion 53 of the metal shell 50 has a cylindrical shape of an outer diameter OD in which a hollow cylindrical space of an inner diameter ID is formed when viewed from the front end side. The front end face 57 is defined between the outer diameter OD and the inner diameter ID. The ground electrode 30 is joined to a given position on the front end face 57 and is bent toward the center electrode 20. During the resistance welding of the ground electrode 30 and the metal shell 50, there is a burr D formed at and around a joint between the base end portion 37 and the front end face 57 by deformation or fusion of the end portion of the ground electrode 30.

An end face of the base end portion 37, i.e., a base end face 39 of the ground electrode 30 is located at the center of the front end face 57 of the metal shell 50 in a specific direction PD that extends perpendicular to the axis OL through a center line CA1 of the base end portion 37 of the ground electrode 30. As a result of the burr D being formed around the base end face 39, the weld region 58 of the front end face 57 of the metal shell 50 joined with the base end portion 37 of the ground electrode 30 is made larger than the base end face 30. Further, the weld region 58 is formed throughout the width of the front end face 57 in the specific direction PD. In the case where the burr D largely extends off from the front end face 57 during the joining of the ground electrode 30 and the metal shell 50, at least some of the extending part is generally removed. Herein, the width of the front end face 57 at the weld region 58 may be referred to as a width W1; the length and width of the base end face 39 of the ground electrode 30 before the joining (welding) may be referred to as a length L and a width W, respectively.

Figure 3:
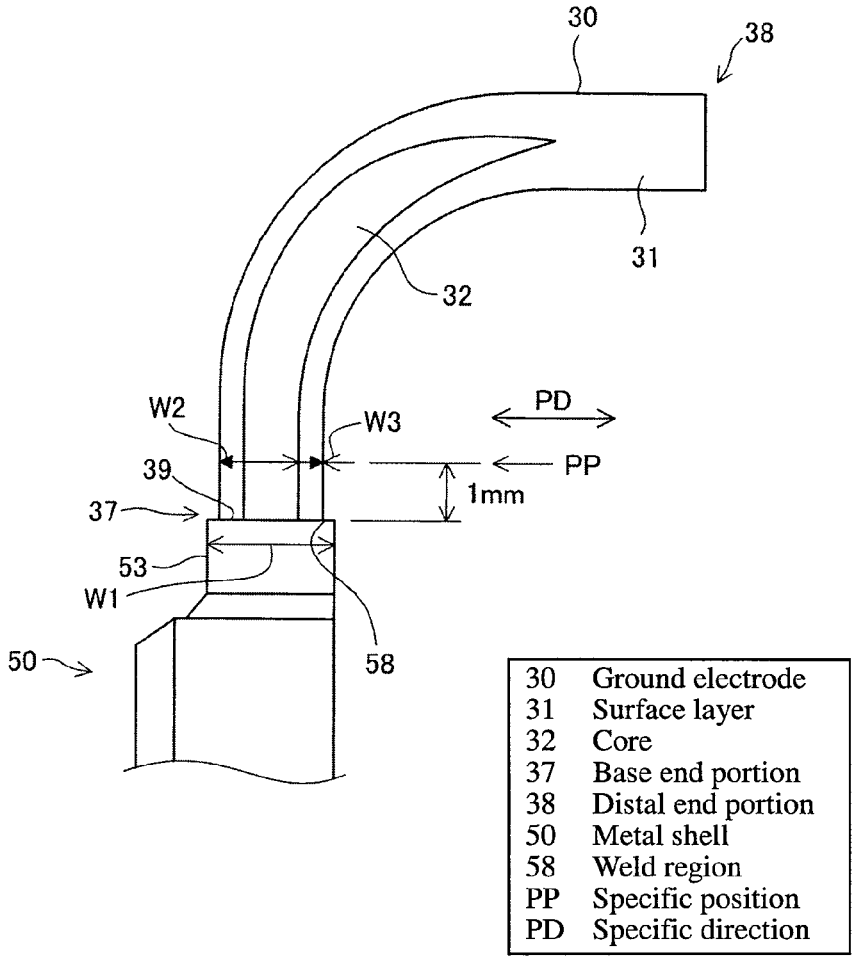
FIG. 3 is a schematic view showing the cross-sectional configuration and dimensions of a ground electrode 30 according to a first embodiment of the present invention.

FIG. 3 is a schematic cross-sectional view of the ground electrode 30. More specifically, FIG. 3 shows a cross section of the ground electrode 30 defined by the axis OL and the specific direction PD. In FIG. 3, the burr D occurring during the resistance welding of the ground electrode 30 and the metal shell 50 is omitted. As shown in the drawing, the ground electrode 30 has a two-layer structure in the present embodiment. In more detail, the ground electrode 30 includes a surface layer 31 defining a surface of the ground electrode 30 and a core 32 located inside the surface layer 31 and having a higher thermal conductivity than that of the surface layer 31.

By the arrangement of such a relatively high thermal conductivity core 32 in the surface layer 31, the heat radiation property of the ground electrode 30 can be increased so that it is possible to improve the heat resistance of the spark plug 100. It is feasible to use a heat-resistant Ni (nickel) alloy as a material of the surface layer 31. As the Ni alloy, there can be used those containing 97 wt % or more of Ni. Further, 0.05 to 1.0 wt % of neodymium (Nd) may be added as a rare earth element. As the rare earth element, not only neodymium but also yttrium (Y) and cerium (Ce) are usable. Chromium (Cr) may also be contained. In the present embodiment, the surface layer 31 is formed of Inconel 600 (trademark). It is feasible to use, as a material of the core 32, pure copper or copper alloy having a higher thermal conductivity than the Ni alloy material of the surface layer 31. In the present embodiment, the core 32 is formed of pure copper.

The surface layer 31 has a thickness of 0.2 to 0.4 mm a position 1 mm from the base end portion 37 (base end face 39) of the ground electrode 30 in a direction toward the distal end portion 38 of the ground electrode 30 along the outer shape of the ground electrode 30 (hereinafter, also referred to as "specific position PP"). The specific position PP can be determined by appearance inspection of the ground electrode 30 in the case where the base end face 39 undulates due to the welding of the ground electrode 30 and the metal shell 50. The specific position PP specifies a site where the burr D does not occur during the welding of the ground electrode 30 and the metal shell 50. Further, the following formula (1) holds between W1, W2 and W3 where W1 (mm) is a width of the weld region 58 (front end face 57) of the metal shell 50 in the specific direction PD; W2 (mm) is a thickness of the ground electrode 30 at the specific position PP in the specific direction PD; and W3 (mm) is a thickness of the surface layer 31 at the specific position PP in the specific direction PD. The width W1 can also given by the following formula (2). In the present embodiment, the dimensions of the ground electrode 30 are constant from the base end portion 37 to the distal end portion 38. Namely, the length L and width W of the ground electrode 30 are constant. The width W can be thus also given by the following formula (3).

$$W1 \geq W2 \times 1.55 - (W3 + 0.25) \quad (1)$$

$$W1 = (OD - ID)/2 \quad (2)$$

$$W2 = W \quad (3)$$

The reason for satisfaction of the formula (1) between the width W1, the thickness W2 and the thickness W3 will be explained below. FIG. 4 shows test results about the joint strength between the ground electrode 30 and the metal shell 50 in the case of varying the length L and width W of the base end face 39 of the ground electrode 30 and the outer diameter OD and inner diameter ID of the metal shell 50. In this test, the ground electrode 30 and the metal shell 50 were joined together in such a manner that the center of the width W1 of the front end face 57 of the ground electrode 50 was in agreement with the center of the thickness W2 of the ground electrode 30. Further, the burr D occurring during the joining of the ground electrode 30 and the metal shell 50 was removed to be 0.2 mm or smaller on each of the outer dimension OD side and the inner dimension ID side.

The joint strength test was performed by the following procedure. (1) A bending operation of bending the ground electrode 30 inwardly (toward the center electrode 20) at 90 degrees about a point 2 mm in the direction along the outer shape of the ground electrode 30 from the base end face 39 of the ground electrode 30 to the distal end portion 38 of the ground electrode 30, and then, bending the ground electrode 30 back to the original position was repeated plural times. (2) The joint strength was evaluated as "normal" (indicated by the symbol "Δ" in FIG. 4) when the number of bending operations by which there occurred a rupture in the joint between the ground electrode 30 and the metal shell 50 was 2 or less. On the other hand, the joint strength was evaluated as "sufficiently high" (indicated by the symbol "○" in FIG. 4) when there occurred no rupture in the joint between the ground electrode 30 and the metal shell 50 in the test.

As shown in FIGS. 4(A) to 4(C), the test results were obtained on three kinds of dimensions of the ground electrode 30 with varying combinations of the width W (W2) and length L. In the ground electrode 30, the thickness W3 of the surface layer 31 was varied between two values: 0.2 mm and 0.4 mm. In the metal shell 50 joined to the ground electrode 30, the outer diameter OD of the metal shell 50 was set depending on the thread size of the spark plug 100; and the inner diameter ID of the metal shell 50 was varied between four values.

For example, the test results of FIG. 4(A) were obtained in the case of joining the ground electrode 30 of width W=1.1 mm and length L=2.2 mm and the metal shell 50 of outer diameter OD=8.45 mm. As seen from these test results, the joint strength was normal when the thickness W3 of the surface layer 31 of the ground electrode was 0.4 mm and the width W1 of the metals shell 50 was 1.025 mm; and the joint strength was sufficiently high when the thickness W3 of the surface layer 31 of the ground electrode 30 was 0.4 mm and the width W1 of the metal shell 50 was 1.325 mm, 1.225 mm or 1.125 mm.

The relationship of the width W2 of the ground electrode 30 and the width W1 of the front end face 57 of the metal shell 50 was determined for each thickness W3 of the surface layer 31 by plotting the above test results as shown in FIG. 5. In FIG. 5, the plot "●" corresponds to the symbol "○" in FIG. 4, that is, indicates that the sufficient joint strength between the ground electrode 30 and the metal shell 50 was secured. On the other hand, the plot "▲" in FIG. 5 corresponds to the symbol "Δ" in FIG. 4, that is, indicates that the joint strength between the ground electrode 30 and the metal shell 50 was normal.

The thickness W3 of the surface layer 31 was 0.2 mm in FIG. 5(A) and 0.4 mm in FIG. 5(B). In the case where the thickness W3 of the surface layer 31 was 0.2 mm, the relationship of the thickness W2 and the width W1 satisfying the formula (1) was specified as the range above line L1 in FIG. 5(A) by substitution of W3=0.2 mm into the formula (1). As clearly shown in FIG. 5(A), all of the plots in such a range were of "●". Namely, the sufficient joint strength between the ground electrode 30 and the metal shell 50 was secured by setting the width W1 and the thickness W2 at values within the range above line L1.

In the case where the thickness W3 of the surface layer 31 was 0.4 mm, the relationship of the thickness W2 and the width W1 satisfying the formula (1) was specified as the range above line L2 in FIG. 5(B) by substitution of W3=0.4 mm into the formula (1). As clearly shown in FIG. 5(B), all of the plots in such a range were of "●". Namely, the sufficient joint strength between the ground electrode 30 and the metal shell 50 was secured by setting the width W1 and the thickness W2 at values within the range above line L2. It has thus been shown by the above explanations that it is possible to secure the sufficient joint strength between the ground electrode 30 and the metal shell 50 by setting the width W1 and the thicknesses W2 and W3 according to the formula (1). Further, it has been confirmed that the material of the surface layer 31, e.g., the Ni content of the surface layer 31 makes almost no contribution to the formula (1).

B. Second Embodiment

A spark plug 200 according to a second embodiment of the present invention will be described below. The spark plug 200 of the second embodiment includes a ground electrode 230 and a metal shell 250 in place of the ground electrode 30 and the metal shell 50 of the first embodiment. The spark plug 200 of the second embodiment is structurally similar to the spark plug 100 of the first embodiment, except that the inner structure of the ground electrode 230 and the cross section of the joint between the ground electrode 230 and the metal shell 250 are different from those of the first embodiment. Hereinafter, differences of the spark plug 200 of the second embodiment from the spark plug 100 of the first embodiment will be explained in detail below.

Figure 6:
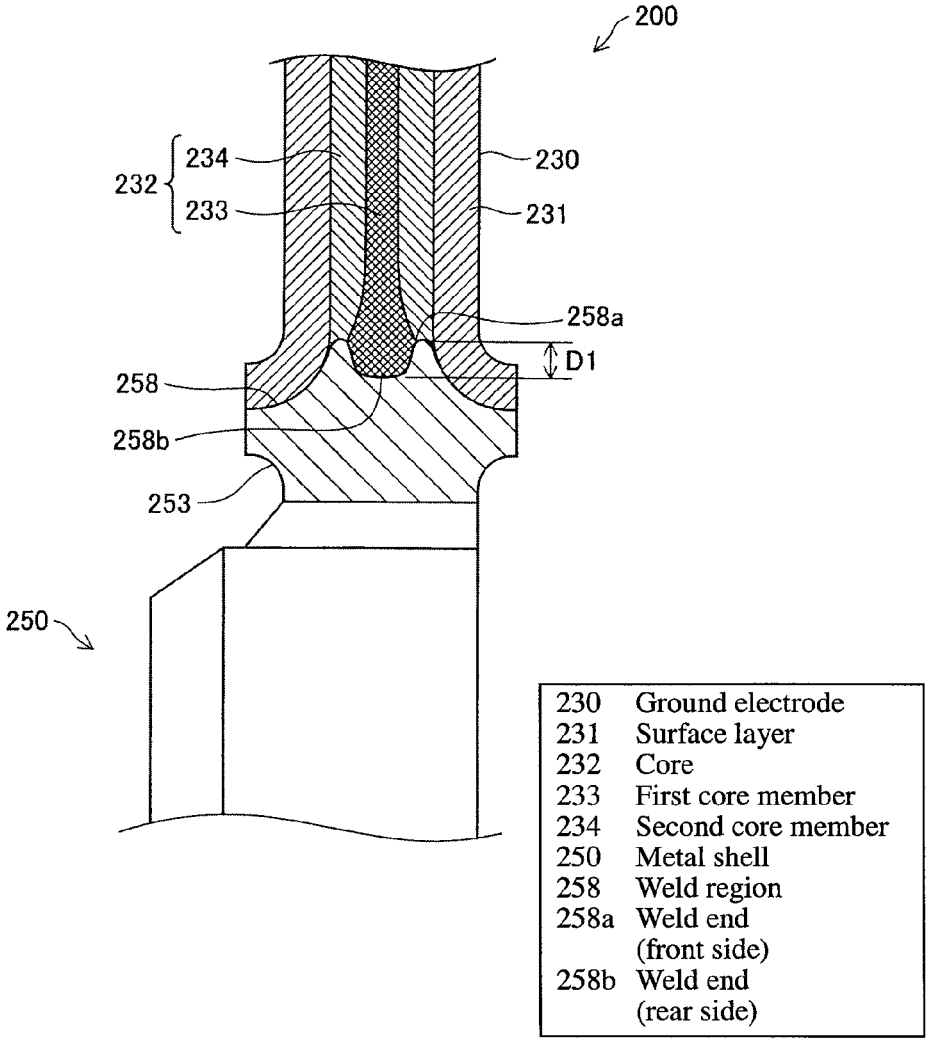
FIG. 6 is a schematic view showing a cross section of joint part between a ground electrode 230 and a metal shell 200 of a spark plug 200 according to a second embodiment of the present invention.

FIG. 6 is a cross-sectional view of the joint between the ground electrode 230 and the metal shell 250 of the spark plug 200. More specifically, FIG. 6 shows a cross section of the joint taken along a plane defined by the axis OL direction and the specific direction PP. As shown in the drawing, the ground electrode 230 has a three-layer structure. In more detail, the ground electrode 230 includes a surface layer 231 defining a surface of the ground electrode 230 and a core 232 located inside the surface layer 231 and having a higher thermal conductivity than that of the surface layer 231. The core 232 consists of a first core member 233 located on an inner side thereof and a second core member 234 located on an outer side thereof so as to circumferentially surround the first core member 233. A material of the second core member 234 has a higher thermal conductivity and a lower hardness than those of a material of the first core member 233. In the present embodiment, the hardness refers to Vickers hardness and, more specifically, micro Vickers hardness. In the present embodiment, the same heat-resistant Ni alloy as that of the first embodiment is used as the material of the surface layer 231. Further, Ni and copper are used as the materials of the first and second core members 233 and 234, respectively. It is possible to improve the joint strength of the three-layer ground electrode 23 by the arrangement of such a relatively high hardness first core member 233 in the second core member 234. The metal shell 250 has a cylindrical portion 235 as in the case of the first embodiment.

A base end part of the surface layer 231 of the ground electrode 230 and a front end part of a cylindrical portion 253 of the metal shell 250 spread outwardly as there is a burr formed due to deformation or fusion of the part of the surface layer 231 and the part of the cylindrical portion 253 during the resistance welding of the ground electrode 230 and the metal shell 250. FIG. 6 is a schematic view of the joint after the removal of opposite ends of the welding burr. In the present embodiment, the ground electrode 230 and the metal shell 250 have the following features.

As shown in FIG. 6, the first core member 233 has a protruding shape that protrudes to a rear of the second core member 234 with respect to the axis OL. A weld region 258 of the cylindrical portion 235 joined with the ground electrode 230 is shaped according to the protruding shape of the first core member 233. More specifically, when taken in cross section as shown in the drawing, the weld region 258 has an undulating shape such that the center of the weld region 258 is recessed by an amount of protrusion of the first core member 233 and such that parts of the weld region 258 on both sides of the first core member 233 protrude to base end parts of the second core member 234. Herein, frontmost and rearmost ends of a part of the weld region 258 held in contact with the first core member 233 with respect to the axis OL direction may be referred to weld ends 258*a* and 258*b*, respectively.

In the spark plug 200, the weld region 258 is formed in such a manner that the distance D1 between the weld ends 258*a* and 258*b* in the axis OL direction is 0.15 mm or more. In the present embodiment, the distance D1 is set to 0.20 mm. Although there is a conventional type of spark plug in which a metal shell has an undulating weld region as mentioned above, the distance D1 is of the order of 0.1 mm in the conventional spark plug.

The ground electrode 230 and the metal shell 250 can be formed into such shapes by controlling the application current, application pressure and energization pattern during the resistance welding of the ground electrode 230 and the metal shell 250.

The reason for setting the distance D1 to 0.15 mm or more will be explained below. The setting standard of the distance D1 has been found by vibration test. In the vibration test, the spark plug 200 was subjected to vibrations conditions simulating vibrations applied to the spark plug 200 during actual use on an internal combustion engine for the purpose of evaluating the joint strength between the ground electrode 230 and the metal shell 250. In the present embodiment, the vibration test was performed based on the impact test method according to JIS B 8031. A plurality of samples of different distance D1 was tested for the time to rupture in the joint between the ground electrode 230 and the metal shell 250. The vibration test was performed on five samples for each distance D1; and the average value of the rupture time measurement results was determined as an average rupture time RT. The rupture time measurement was conducted for maximum 60 minutes. The rupture time was indicated as 60 minutes when there occurred no rupture within 60 minutes. Further, the test was performed under heated conditions that the temperature of the front end portion 230 of the ground electrode 230 was set to 900° C. on the assumption of the actual use conditions of the spark plug 200.

FIG. 7 shows vibration test results. The test results were obtained on the samples of the spark plug 200 using three kinds of dimensions of the ground electrode 230 with varying combinations of the width W and length L. These three kinds of dimensions correspond to those of the test results of FIG. 4. Although the thickness W3 of the surface layer 231 could be varied within the range of 0.2 to 0.4 mm as in the case of the first embodiment, the ground electrode 230 of W3=0 2 mm was used for adoption of unfavorable strength conditions in the test. The width W1 of the weld region 258 in the specific direction PD was varied between 1.225 mm (W 1.1×L 2.2), 1.55 mm (W 1.3×L 2.7) and 1.85 mm (W 1.5×L 2.8).

In the case of using the ground electrode 230 of W 1.1 mm×L 2.2 mm, for example, the average rupture time RT was 31 minutes when the distance D1 was 0.05 mm. On the other hand, the average rupture time RT was 60 minutes, that is, there occurred no rupture when the distance D1 was 0.14 mm or 0.18 mm.

Figure 8:
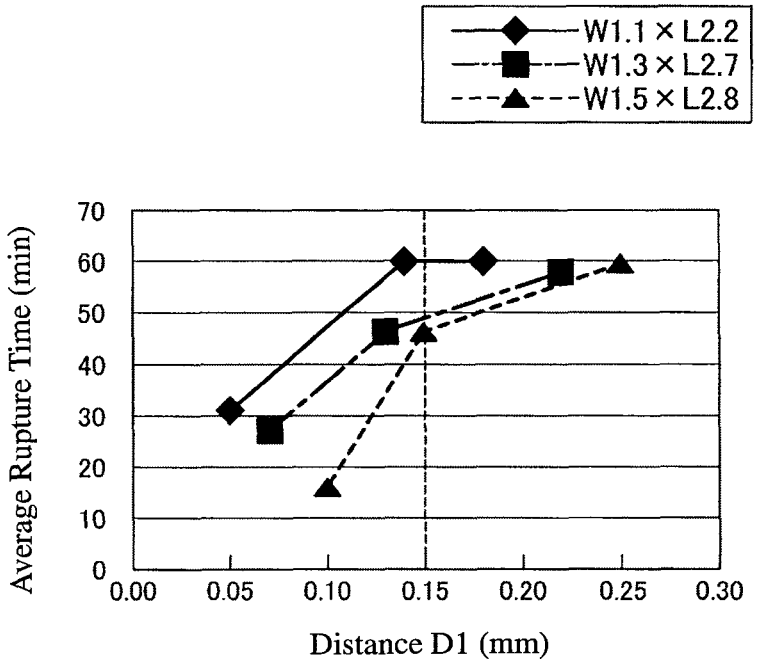
FIG. 8 is a graph showing impact test results on the spark plug 200.

The relationship of the distance D1 and the average rupture time RT was determined for each dimension type of the ground electrode 230 by plotting the above vibration test results as shown in FIG. 8. As shown in the drawing, the average rupture time RT increased with the distance D1 in each dimension type of the ground electrode 230. In the case of using the ground electrode 230 of W 1.1 mm×L 2.2 mm, the average rupture time RT was 60 min, that is, there occurred no rupture when the distance D1 was set to approximately 0.15 mm or more. In the case of using the ground electrode 230 of W 1.5 mm×L 2.8 mm, the average rupture time was 46 minutes. Namely, the joint strength was significantly improved as compared to the conventional type (D=about 0.10) where the average rupture time was 16 minutes. It has thus been shown that it is possible to improve the joint strength between the ground electrode 230 and the metal shell 250 by forming the ground electrode 230 and the metal shell 250 in such a manner as to set the distance D1 to be 0.15 mm or more. This effect can be obtained according to the decrease of the amount of the relatively low-strength second core member 234 in the base end portion of the ground electrode 230.

C. Third Embodiment

Figure 9:
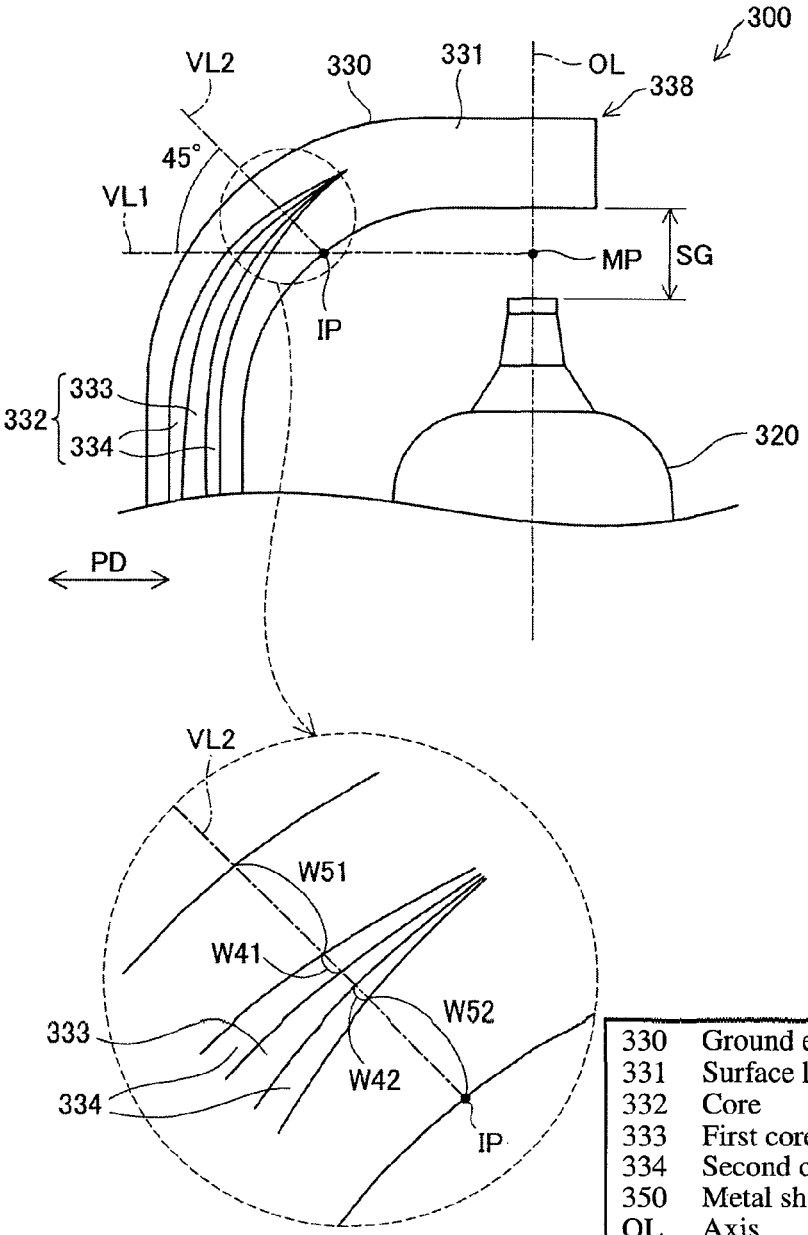
FIG. 9 is a schematic view showing the cross-sectional configuration and dimensions of a ground electrode 330 of a spark plug 300 according to a third embodiment of the present embodiment.

A spark plug 300 according to a third embodiment of the present invention will be described below. The spark plug 300 of the third embodiment is structurally similar to the spark plug 100 of the first embodiment, except that the spark plug 300 includes a ground electrode 33 in place of the ground electrode 30 of the first embodiment. Hereinafter, differences of the spark plug 300 of the third embodiment from the spark plug 100 of the first embodiment will be explained in detail below. FIG. 9 is a schematic cross-sectional view of the ground electrode 330. More specifically, FIG. 9 shows a cross section of the ground electrode 330 taken along a plane defined by the axis OL direction and the specific direction PP. As shown in the drawing, the ground electrode 330 has a three-layer structure as in the case of the second embodiment. In more detail, the ground electrode 330 includes a surface layer 331 and a core 332. The core 332 consists of a first core member 333 and a second core member 334. Materials of the surface layer 331, the first core member 333 and the second core member 334 are the same as those of the second embodiment.

The core 332 is located in substantially the center of the ground electrode 330. The core 332 has a shape tapering down toward a distal end portion 338 of the ground electrode 330. Namely, the thickness of the core 332 gradually decreases toward the distal end portion 338. In other words, the thickness of the surface layer 331 gradually increases toward the distal end portion 338. Further, the core 332 is not located in the vicinity of the distal end portion 338 of the ground electrode 330. The above inner structure of the ground electrode 330 results from the production process of the ground electrode 330.

When viewed in cross section, there is a spark gap SG defined between the center electrode 320 and the ground electrode 330 in the axis OL direction. In the cross section of the ground electrode 330, an imaginary line extending in parallel to the specific direction PD through a midpoint MP of the spark gap SG is referred to as a first imaginary line VL1; and an imaginary line passing through an intersection point IP of the first imaginary line VL2 and a plane of the ground electrode 33 located closer to the center electrode 320 and intersecting the first imaginary line VL2 at an elevation angle of 45 degrees toward the specific direction PD is referred to as a second imaginary line VL2. In the present embodiment, the ground electrode 330 is formed in such a manner as to satisfy the following formula (4) where W41 and W42 are widths of the second core member 334 on the second imaginary line VL2; W51 and W52 are widths of the surface layer 31 on the second imaginary line VL2; W4=W41+W42; and W5=W51+W52.

$$W4/W5 \leq 0.34 \quad (4)$$

Figure 10:
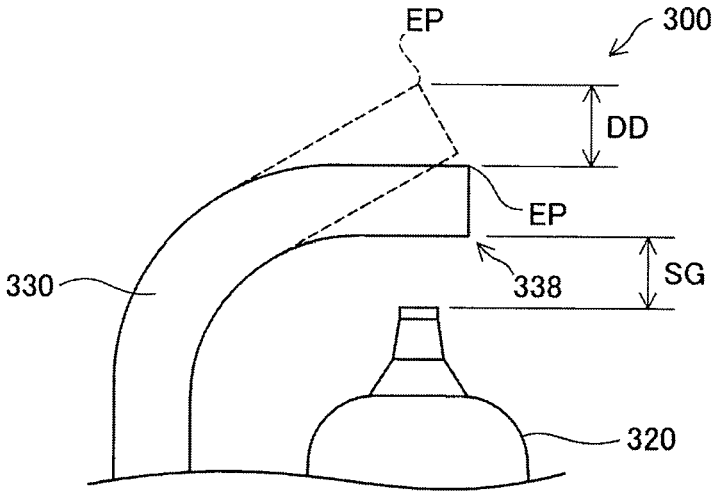
FIG. 10 is a schematic view showing a state in which the ground electrode 30 is deformed due to heating/cooling cycles.

The reason for satisfaction of the formula (4) will be explained below. The formula (4) has been derived by heating/cooling cycle test. When the spark plug 300 with the multilayer ground electrode 330 is mounted to an engine head and subjected to heating/cooling cycles during actual use on an internal combustion engine, a bent portion of the ground electrode 330 becomes deformed outwardly, i.e., toward a side opposite from the center electrode 320 due to a difference in thermal expansion coefficient between the surface layer 331 and the core 332. This causes an increase of the spark gap SG. FIG. 10 is a schematic view showing such a deformed state. In FIG. 10, the shape of the ground electrode 330 before the deformation is indicated by a solid line; and the shape of the ground electrode 330 after the deformation is indicated by a dotted line. Herein, an end point of the distal end portion 338 located opposite from the center electrode 320 is referred to as end point EP; and the amount of displacement of the end point EP in the axis OL direction due to such deformation of the ground electrode 330 is referred to as displacement amount DD. In the heating/cooling cycle test, the spark plug 300 was subjected to heating/cooling cycle conditions simulating heating/cooling cycles during actual use on the internal combustion engine for measurement of the displacement amount DD.

In the present embodiment, the heating/cooling cycle test was performed by preparing samples of the spark plug 300 in which the value W4/W5 was varied, and then, subjecting each of the samples of the spark plug 300 to heating/cooling cycle conditions where the operation of heating the ground electrode 330 up to maximum 900° C. for 2 minutes with the use of a burner and cooling the ground electrode 300 naturally for 1 minute was assumed as one cycle. The displacement amount DD was measured after repeating 5000 cycles.

FIG. 11 shows heating/cooling cycle test results. In FIG. 11, the test results were obtained by varying the width dimensions W4 and W5 of the ground electrode 330 to determine the relationship of the value W4/W5 and the displacement amount DD. In the case of using the ground electrode 330 of W5=1.58 mm and W4=0.36 mm, i.e., W4/W5=0.23, for example, the displacement amount DD was 0 mm. Namely, no deformation occurred in the ground electrode 30. On the other hand, the displacement amount DD was 0.05 mm in the case of using the ground electrode 330 of W5=1.55 mm and W4=0.66 mm, i.e., W4/W5=0.43. In this case, there thus occurred deformation in the ground electrode 330. In FIG. 11, the value W4/W5 at which some deformation occurred in the ground electrode 330 is indicated by hatching.

Figure 12:
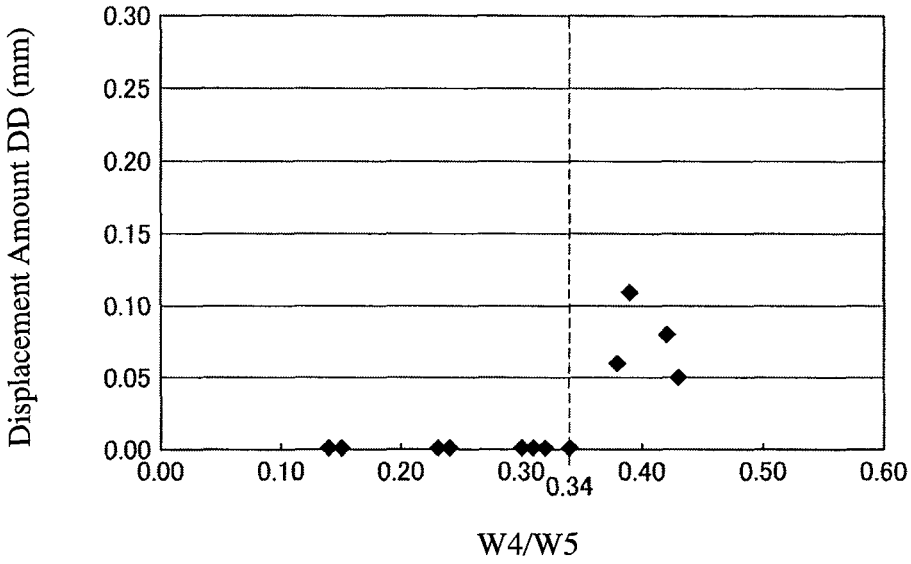
FIG. 12 is a graph showing test results about the deformation of the ground electrode 330 due to heating/cooling cycles.

The relationship of the value W4/W5 and the displacement amount DD was determined by plotting the above heating/cooling cycle test results as shown in FIG. 12. As seen from the drawing, no deformation occurred by the heating/cooling cycles when the value W4/W5 was 0.34 or smaller. It has thus been shown that it is possible by setting the value W4/W5 according to the formula (4) to prevent the ground electrode 330 of the spark plug 300 from being deformed by heating/cooling cycles.

D. Fourth Embodiment

Figure 13:
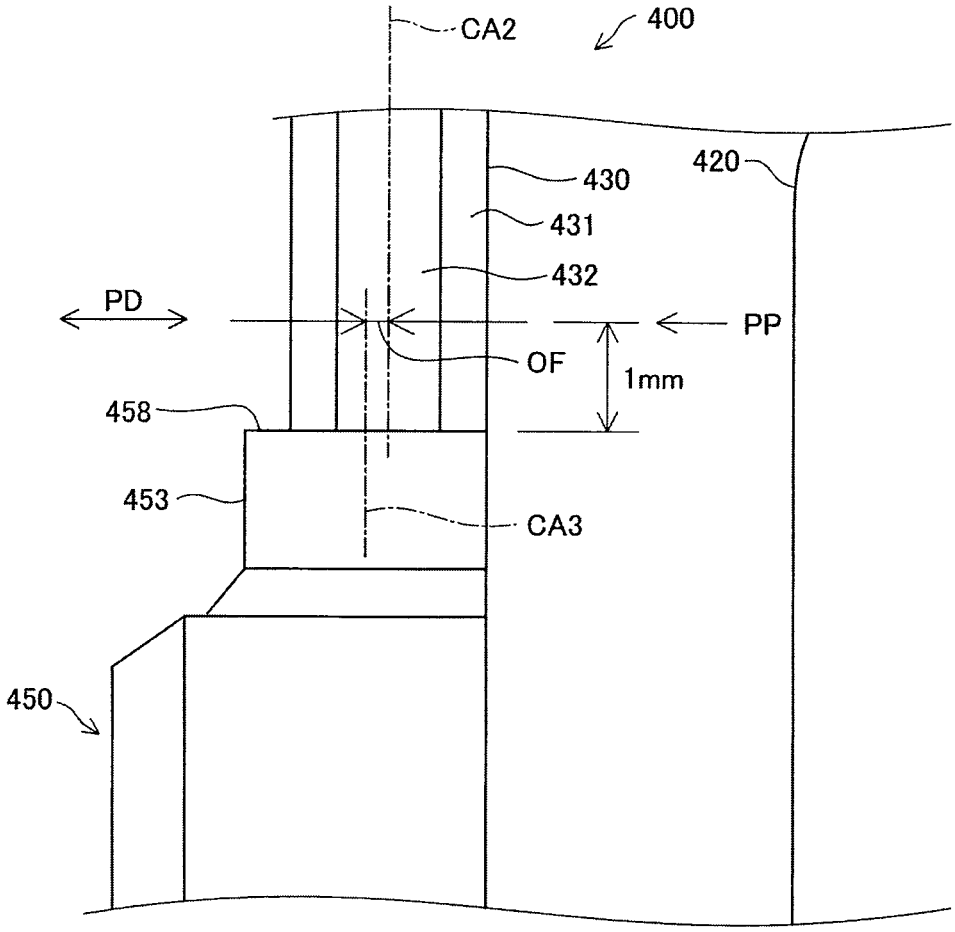
FIG. 13 is a schematic view showing the cross-sectional configuration and dimensions of a ground electrode 430 of a spark plug 400 according to a fourth embodiment of the present invention.

A spark plug 400 according to a fourth embodiment of the present invention will be described below. The spark plug 400 of the fourth embodiment is structurally similar to the spark plug 100 of the first embodiment, except that the joint position between a ground electrode 430 and a metal shell 450 of the spark plug 400 is different from that of the first embodiment. Hereinafter, differences of the spark plug 400 of the fourth embodiment from the spark plug 100 of the first embodiment will be explained in detail below. FIG. 13 is a schematic view showing the joint position between the ground electrode 430 and the metal shell 450 of the spark plug 400. More specifically, FIG. 13 shows a cross section of the joint taken along a plane defined by the axis OL direction and the specific direction PP. In FIG. 13, a burr D is omitted. A ceramic insulator between the ground electrode 430 and the center electrode 420 is also omitted in FIG. 13. The ground electrode 430 has the same structure as the ground electrode 30 of the first embodiment and thus includes a surface layer 431 and a core 432. The ground electrode 430 is joined to the metal shell 450. The metal shell 450 has the same structure as the metal shell 50 of the first embodiment.

Herein, a center line of the ground electrode 430 extending at the specific position PP in the axis OL direction is referred to as center line CA2; and a center line of the metal shell 450 extending at a weld region 458 in the axis OL direction is referred to as center line CA3. In the spark plug 400, the ground electrode 430 and the metal shell 450 are joined together in such a manner that the center line CA2 is located closer to the center electrode 420 than the center line CA3. It can be said that, by such a positional relationship, the ground electrode 430 is offset toward the center electrode 420. In the above positional relationship of the center lines CA2 and CA3, the distance of separation between the center lines CA2 and CA3 is referred to as offset amount OF.

The reason for joining the ground electrode 430 and the metal shell 450 with the ground electrode 430 being offset toward the center electrode 420 will be explained below. This positional relationship has been found by vibration test. FIG. 14 shows vibration test results. These test results were obtained on samples of the spark plug 400 using three kinds of dimensions of the ground electrode 430 with varying combinations of the width W and length L. The procedure of the vibration test was the same as that of the second embodiment. In the case of the spark plug 400 in which the ground electrode 430 of W 1.1 mm×L 2.2 mm was joined to the metal shell 450, for example, the average rupture time RT was 31 minutes when the offset amount OF was 0.00 mm. On the other hand, the average rupture time RT was 60 minutes, that is, there occurred no rupture when the offset amount OF was 0.07 mm in that case.

Figure 15:
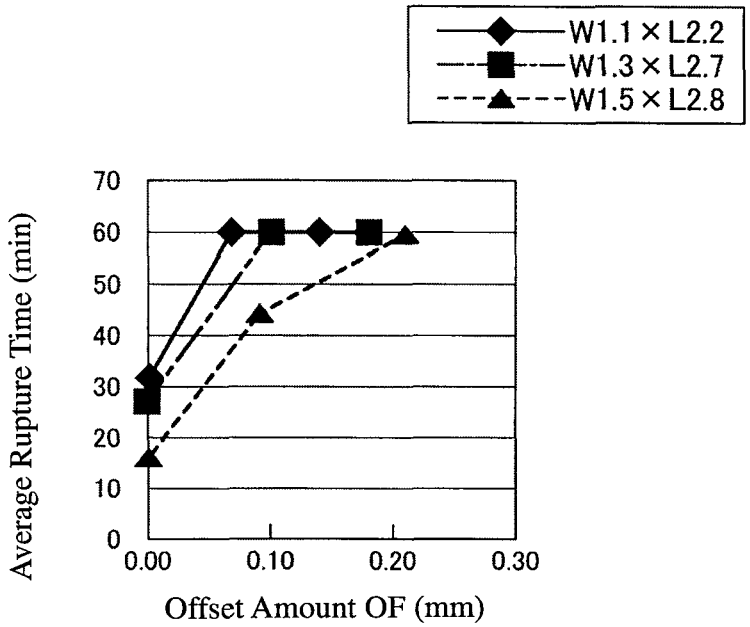
FIG. 15 is a graph showing impact test results on the spark plug 400.

The relationship of the offset amount OF and the average rupture time RT was determined by plotting the above vibration test results as shown in FIG. 15. As seen from the drawing, the average rupture time RT increased with the offset amount OF. It has thus been shown that it is possible, by setting the Offset amount OF at a positive value, i.e., by joining the ground electrode 430 to the metal shell 450 in such a manner as to satisfy the positional relationship that the center line CA2 is located closer to the center electrode 420 than the center line CA3, to improve the joint strength between the ground electrode 430 and the metal shell 450.

This effect can be obtained according to the fact that, when the ground electrode 430 is offset toward the center electrode 420 due to a difference between the outer diameter OD and inner diameter ID of the weld region 458, the surface area of the burr D formed on the front end face of the metal shell 450, that is, the surface area of the weld region 458 increases. It is feasible to set the offset amount OF as appropriate within the range that, in the positional relationship of the ground electrode 430 and the metal shell 450 before the welding, the offset amount OF has a maximum value at a point where a surface of the metal shell 450 facing the center electrode 420 and a surface of the ground electrode 430 facing the center electrode 420 are located at the same position in the specific direction PD (at the position shown in FIG. 13).

E. Fifth Embodiment

A spark plug 500 according to a fifth embodiment of the present invention will be described below. The spark plug 500 of the fifth embodiment includes a ground electrode 530 and a metal shell 550 in place of the ground electrode 30 and the metal shell 50 of the first embodiment. The spark plug 500 of the fifth embodiment is structurally similar to the spark plug 100 of the first embodiment, except that a cross-sectional profile of the joint between the ground electrode 530 and the metal shell 550 is different from that of the first embodiment. Hereinafter, differences of the spark plug 500 of the fifth embodiment from the spark plug 100 of the first embodiment will be explained in detail below.

Figure 16:
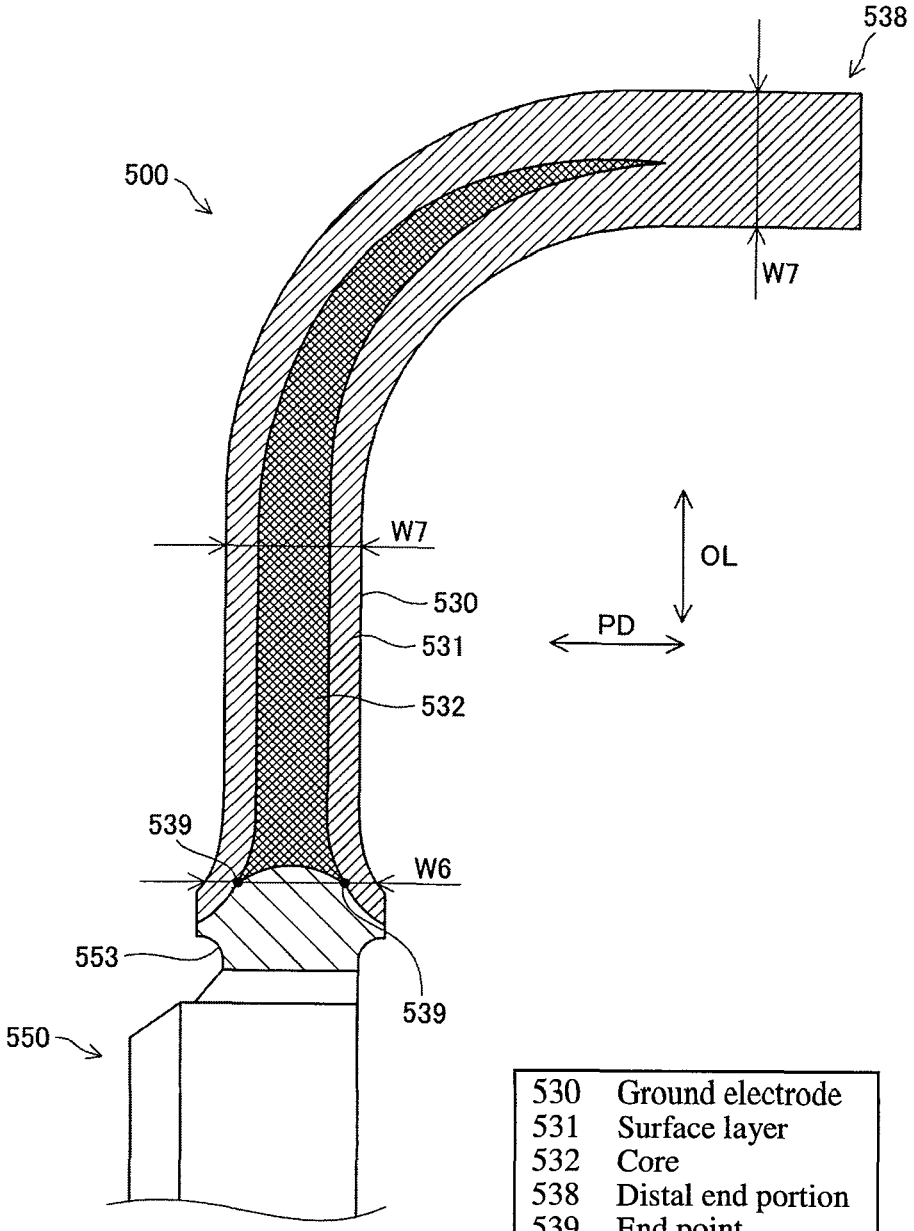
FIG. 16 is a schematic view showing the cross-sectional configuration and dimensions of a ground electrode 530 of a spark plug 500 according to a fifth embodiment of the present invention.

FIG. 16 is a schematic cross-sectional view of the joint between the ground electrode 530 and the metal shell 550 of the spark plug 500. More specifically, FIG. 16 shows a cross section of the joint taken along a plane defined by the axis OL direction and the specific direction PP. The ground electrode 530 has the same structure as the ground electrode 30 of the first embodiment, except for the cross-sectional profile between the ground electrode 530 and the metal shell 550, and includes a surface layer 531 and a core 532. The ground electrode 530 is joined to the metal shell 550. The metal shell 550 has the same structure as the metal shell 50 of the first embodiment, except for the cross-sectional profile between the ground electrode 530 and the metal shell 550.

When the joint between the ground electrode 530 and the metal shell 550 is taken in cross section as shown in FIG. 16, a base end part of the surface layer 531 of the ground electrode 530 and a front end part of a cylindrical portion 553 of the metal shell 550 spread outwardly due to the formation of a burr D during the resistance welding of the ground electrode 530 and the metal shell 550. FIG. 16 is a schematic view of the joint after the removal of opposite ends of the burr D. Further, the metal shell 550 has a protruding shape that protrudes at the center thereof toward the front in the axis OL direction; and the core 532 of the ground electrode 530 has an undulating shape that undulates according to the protruding shape of the metal shell 550. More specifically, the core 532 has such a shape that the center of the core 532 in the specific direction PD is recessed toward the front in the axis OL direction and both sides of the core 532 in the specific direction PD extends to rear end points 539 in the axis OL direction. In the present embodiment, the end points 539 on the both sides of the core 532 in the specific direction PD are formed at the same position in the axis OL direction. These end points 538 are located front of the removed part of the burr D in the axis OL direction.

Because of the above-mentioned outwardly spread shape, the outer thickness W6 of the ground electrode 530 at the end points 539 in the specific direction PD is made larger than the thickness W7 of a distal end portion 538 of the ground electrode 530. In the present embodiment, the length L and width W of the ground electrode 530 are constant as in the case of the first embodiment. Any part of the ground electrode 530 that is not formed into the above outwardly spread shape has a thickness of W7 in the specific direction PD.

The ground electrode 530 and the metal shell 550 can be formed into such shapes by adjusting the shape of a jig for chucking inner and outer circumferential surfaces of the ground electrode during the resistance welding of the ground electrode 530 and the metal shell 550.

The reason for forming the above-shaped cross-sectional profile of the joint between the ground electrode 530 and the metal shell 550 will be explained below. The above-shaped cross-sectional profile has been found by vibration test. FIG.

17 shows vibration test results. These test results were obtained on samples of the spark plug 500 using three kinds of dimensions of the ground electrode 530 with varying combinations of the width W and length L. The procedure of the vibration test was the same as that of the second embodiment. In the case of the spark plug 500 in which the ground electrode 530 of W 1.3 mm×L 2.7 mm was joined to the metal shell 450, for example, the average rupture time RT was 27 minutes when the value W6/W7 was 1.00. On the other hand, the average rupture time RT was 60 minutes, that is, there occurred no rupture when the value W6/W7 was 1.22 in that case.

Figure 18:
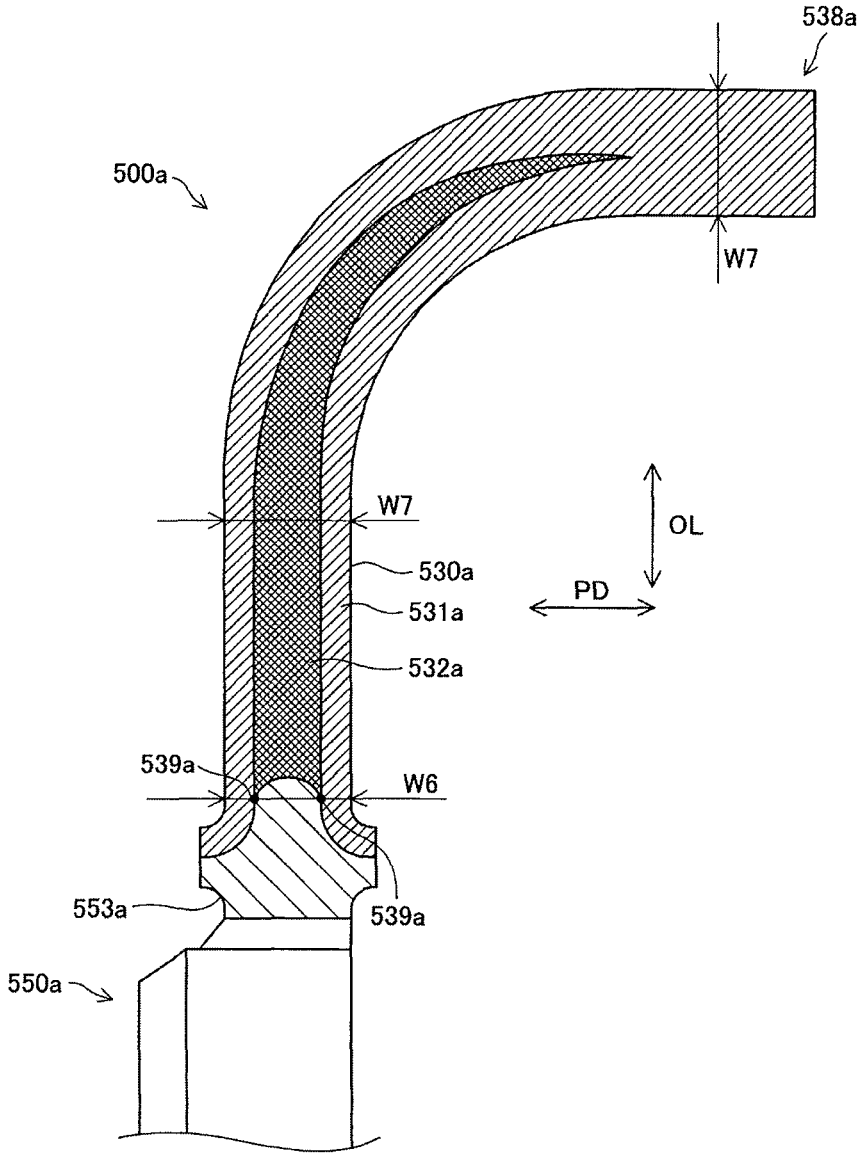
FIG. 18 is a schematic view showing the cross-sectional configuration and dimensions of a ground electrode 530*a* of a spark plug 500*a* according to comparative example.

FIG. 18 is a schematic view of a spark plug 500*a* as a comparative example. In FIG. 18, the respective components of the spark plug 500*a* are designated by reference numerals corresponding to those of the spark plug 500 of FIG. 16 with the letter "a" added to ends thereof. In the spark plug 500*a* of this comparative example, end points 539*a* are located front of an outwardly spread rear end part of a surface layer 531*a* and an outwardly spread front end part of a cylindrical portion 553*a* as shown in FIG. 18. In this case, the thickness W6 is equal to the thickness W6. Namely, the case of W6/W7=1.0 in the vibration test refers to the shape of the spark plug 500*a*.

Figure 19:
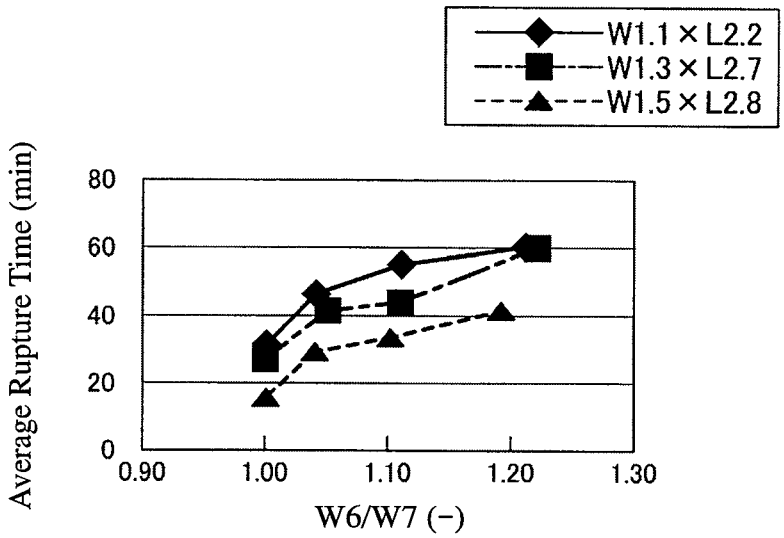
FIG. 19 is a graph showing impact test results on the spark plug 500.

The relationship of the value W6/W7 and the average rupture time RT was determined by plotting the above vibration test results as shown in FIG. 19. As seen from the drawing, the average rupture time RT increased as the value W6/W7 became larger than 1.00 on each dimension of the ground electrode 530. Namely, the average rupture time RT increases as the outer thickness W6 of the ground electrode 530 at the end points 539 became larger than the thickness W7 of the distal end portion 538 of the ground electrode 530. It has thus been shown that it is possible to improve the joint strength between the ground electrode 530 and the metal shell 550 by forming the ground electrode 530 and the metal shell 550 in such a manner that the thickness W6 becomes larger than the thickness W7, i.e., in such a manner that the end points 539 of the core 532, which is lower in strength than the surface layer 531, are located in the relatively large thickness part of the ground electrode 530.

Although the opposite end points 539 of the core 532 in the specific direction PD are located at the same position in the axis OL direction in the above embodiment, there is a case where the positions of these end points 539 do not strictly coincide with each other because of manufacturing errors etc. In such a case, the thickness W6 can be determined as the outer thickness of the ground electrode 530 in the specific direction PD at the relatively front one of the two end points 539.

F. Modifications

Each of the above embodiments has been described as the spark plug of vertical discharge type in which the spark gap SG is defined in the axis OL direction. However, the spark plug of the present invention is not limited to such type. The present invention can be applied to various types of spark plugs. For example, the spark plug of the first, second, fourth or fifth embodiment may be embodied as a spark plug of lateral discharge type in which a spark discharge occurs in a direction perpendicular to the axis OL direction. Further, the spark plug may be provided with a plurality of ground electrodes relative to one center electrode.

Although the present invention has been described with reference to the above embodiments, the constituent features of the present embodiment other than those described in independent claim are additional features. These additional features can be omitted as appropriate or can be adopted in any combination. The present invention is not limited to the above embodiments. Various modification and variations of the above embodiments are possible within the technical scope of the present invention.

DESCRIPTION OF REFERENCE NUMERALS

10: Ceramic insulator
12: Axial hole
20, 320, 420: Center electrode
30, 230, 330, 430, 530: Ground electrode
31, 231, 331, 431, 531: Surface layer
32, 232, 332, 432, 532, Core
37: Base end portion
38, 338, 538: Distal end portion
39: Base end face
50, 250, 450, 550: Metal shell
58, 258, 458: Weld region
100, 200, 300, 400, 500: Spark plug
233, 333: First core member
234, 334: Second core member
258*a*, 258*b*: Weld end
OL: Axis
PD: Specific direction
PP: Specific position
SG: Spark gap
CA1, CA2, CA3: Center line
VL1: First imaginary line
VL2: Second imaginary line Having described the invention, the following is claimed:

1. A spark plug, comprising:

a rod-shaped center electrode extending in an axis direction of the spark plug;

an insulator having an axial hole formed in the axis direction so as to retain the center electrode in the axial hole;

a metal shell circumferentially surrounding and retaining the insulator; and a ground electrode having a base end portion welded to the metal shell to define a weld region and a distal end portion facing an axially front end portion of the center electrode with a gap left between the distal end portion of the ground electrode and the front end portion of the center electrode, the ground electrode including a surface layer defining a surface of the ground electrode and a core located inside the surface layer and having a higher thermal conductivity than that of the surface layer, the surface layer having a thickness of 0.2 mm to 0.4 mm at a specific position that is located 1 mm from the base end portion in a direction toward the distal end portion along an outer shape of the ground electrode, wherein the core includes a first core member located on an inner side thereof and a second core member located on an outer side thereof so as to circumferentially surround the first core member and having a higher thermal conductivity and a lower hardness than those of the first core member;

wherein the first core member has a protruding shape that protrudes to a rear of the second core member in the axis direction;

wherein the weld region has an undulating shape that undulates according to the protruding shape of the first core member; and wherein a distance between frontmost and rearmost ends of a part of the weld region in contact with the first core member in the axis direction is 0.15 mm or more.

2. The spark plug according to claim 1, wherein, when viewed in cross section along a plane defined by the axis direction and the specific direction, the spark plug satisfies the following condition: $W4/W5 \leq 0.34$ where, on the assumption that: a first imaginary line extends in parallel to the specific direction through a midpoint of a spark gap SG, which is defined between the center electrode and the ground electrode in the axis direction; and a second imaginary line passes through an intersection point of the first imaginary line and a plane of the ground electrode located closer to the center electrode and intersecting the first imaginary line at an elevation angle of 45 degrees toward the specific direction, W4 is the sum of widths of the second core member on the secondary imaginary line; and W5 is the sum of widths of the surface layer on the second imaginary line.

3. The spark plug according to claim 2, wherein, when viewed in cross section parallel to a plane defined by the axis direction and the specific direction, a center line of the ground electrode extending at the specific position in the axis direction is located closer to the center electrode than a center line of the metal shell extending at the weld region in the axis direction.

4. The spark plug according to claim 2, wherein, when viewed in cross section parallel to a plane defined by the axis direction and the specific direction, the metal shell has a protruding shape that protrudes at the center thereof toward the front in the axial direction, and the core has an undulating shape that undulates according to the protruding shape of the metal shell, and an outer thickness of the ground electrode in the specific direction at axially rear end points of the core is larger than a thickness of the distal end portion of the ground electrode.

5. The spark plug according to claim 1, wherein, when viewed in cross section parallel to a plane defined by the axis direction and the specific direction, a center line of the ground electrode extending at the specific position in the axis direction is located closer to the center electrode than a center line of the metal shell extending at the weld region in the axis direction.

6. The spark plug according to claim 5, wherein, when viewed in cross section parallel to a plane defined by the axis direction and the specific direction, the metal shell has a protruding shape that protrudes at the center thereof toward the front in the axial direction, and the core has an undulating shape that undulates according to the protruding shape of the metal shell, and an outer thickness of the ground electrode in the specific direction at axially rear end points of the core is larger than a thickness of the distal end portion of the ground electrode.

7. The spark plug according to claim 1, wherein, when viewed in cross section parallel to a plane defined by the axis direction and the specific direction, the metal shell has a protruding shape that protrudes at the center thereof toward the front in the axial direction, and the core has an undulating shape that undulates according to the protruding shape of the metal shell, and an outer thickness of the ground electrode in the specific direction at axially rear end points of the core is larger than a thickness of the distal end portion of the ground electrode.

* * * * *